US012429233B2

(12) United States Patent
Pfister

(10) Patent No.: US 12,429,233 B2
(45) Date of Patent: Sep. 30, 2025

(54) ADIABATIC COOLING SYSTEM WITH PAD SUPPORT

(71) Applicant: Heatcraft Refrigeration Products LLC, Stone Mountain, GA (US)

(72) Inventor: Steve Pfister, Dunwoody, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 168 days.

(21) Appl. No.: 18/340,768

(22) Filed: Jun. 23, 2023

(65) Prior Publication Data

US 2024/0426487 A1 Dec. 26, 2024

(51) Int. Cl.
*F24F 1/16* (2011.01)
*F24F 1/48* (2011.01)

(52) U.S. Cl.
CPC . *F24F 1/16* (2013.01); *F24F 1/48* (2013.01)

(58) Field of Classification Search
CPC .... F24F 1/16; F24F 1/48; F24F 5/0035; F24F 13/30; Y10S 261/41; Y10S 55/31; F28F 25/02
See application file for complete search history.

(56) References Cited

U.S. PATENT DOCUMENTS 2,850,269 A * 9/1958 Bohanon ..... F24F 6/04 55/491
3,716,043 A * 2/1973 Chilcoat ..... F24F 6/04 261/106
4,031,180 A * 6/1977 Bohanon ..... F24F 6/04 55/504
4,080,410 A * 3/1978 Goettl ..... F28C 1/04 220/678
4,389,352 A * 6/1983 Bohanon, Sr. ..... F24F 6/04 261/106
5,211,891 A * 5/1993 Anoszko ..... B01F 23/215 261/106

FOREIGN PATENT DOCUMENTS

DE 102016011879 A1 * 4/2018
EP 1698847 A1 * 9/2006 ..... F28C 1/14

* cited by examiner

*Primary Examiner* — Frantz F Jules
*Assistant Examiner* — Martha Tadesse

(57) ABSTRACT

An adiabatic cooling system includes a condenser coil and one or more adiabatic pads positioned such that intake air for the adiabatic cooling system passes through the one or more adiabatic pads prior to contacting the condenser coil. The adiabatic cooling system further includes a gutter disposed underneath each of the one or more adiabatic pads configured to receive water exiting from the one or more adiabatic pads. The adiabatic cooling system further includes a bracket disposed within and secured to the gutter configured to support the one or more adiabatic pads, wherein at least one of the one or more adiabatic pads is disposed on top of the bracket.

19 Claims, 5 Drawing Sheets

ADIABATIC COOLING SYSTEM WITH PAD SUPPORT

TECHNICAL FIELD

This disclosure relates in general to adiabatic cooling systems, and more particularly to an adiabatic cooling system with pad support.

BACKGROUND

Cooling systems are used in many types of residential and commercial applications. As one example, commercial refrigeration systems are used by many types of businesses such as supermarkets and warehouses.

SUMMARY

Cooling systems may use adiabatic cooling processes to pre-cool intake air that enters an outdoor condenser unit. For example, intake air may first pass through a wet pad or mesh material. Heat transfer with water on the material pre-cools the intake air. In examples, any adiabatic water system may be applicable to carbon dioxide ($CO_2$) gas coolers, and adiabatic systems using other suitable refrigerants may utilize condensers. This disclosure recognizes drawbacks and disadvantages of conventional approaches to providing adiabatic cooling. For example, conventional pads used for adiabatic cooling may be supported by a gutter disposed underneath that functions to collect and provide drainage to the water leaving the pads. The weight of the pads and the collected water can structurally damage the gutter and induce leaking.

This disclosure provides a technical solution to problems of previous adiabatic cooling technology, including those recognized above, by providing a bracket to structurally support the adiabatic pads. The bracket is positioned within a gutter underneath the adiabatic pads and allows water to flow therethrough and into the gutter from the pads. The water is then drained and circulated for re-use by the system. By using the bracket, the gutter does not have to receive and structurally support the weight of the adiabatic pads.

Certain embodiments may include none, some, or all of the above technical advantages. One or more other technical advantages may be readily apparent to one skilled in the art from the figures, descriptions, and claims included herein.

In an embodiment, an adiabatic cooling system includes a condenser coil and one or more adiabatic pads positioned such that intake air for the adiabatic cooling system passes through the one or more adiabatic pads prior to contacting the condenser coil. The adiabatic cooling system further includes a gutter disposed underneath each of the one or more adiabatic pads configured to receive water exiting from the one or more adiabatic pads. The adiabatic cooling system further includes a bracket disposed within and secured to the gutter configured to support the one or more adiabatic pads, wherein at least one of the one or more adiabatic pads is disposed on top of the bracket.

BRIEF DESCRIPTION OF THE DRAWINGS

For a more complete understanding of the present disclosure and its advantages, reference is now made to the following description, taken in conjunction with the accompanying drawings, in which.

DETAILED DESCRIPTION

Gas cooling systems are used in many types of residential and commercial applications. As one example, commercial refrigeration systems are used by many types of businesses such as supermarkets and warehouses. Many cooling systems use adiabatic cooling processes to pre-cool air before it enters an outdoor condenser unit. For example, large commercial refrigeration systems may include air cooled condensers where cooling pads are contacted with water in order to pre-cool intake air before it contacts condenser coils. In these examples, any adiabatic water system may be applicable to carbon dioxide ($CO_2$) gas coolers, and adiabatic systems using other suitable refrigerants may utilize condensers. While pre-cooling air using cooling pads aids in the overall efficiency of cooling systems in certain environmental conditions, existing configurations with drainage components, such as a gutter, are problematic. Existing configurations provide the gutter structurally supporting the weight of the cooling pads, wherein the gutter may fail and encounter leakage of any collected fluids.

To address these and other limitations of previous adiabatic cooling system technology, embodiments of this disclosure facilitate improved adiabatic cooling. The following describes adiabatic cooling systems with a bracket functioning with the gutter to structurally support the cooling pads.

Figure 1:
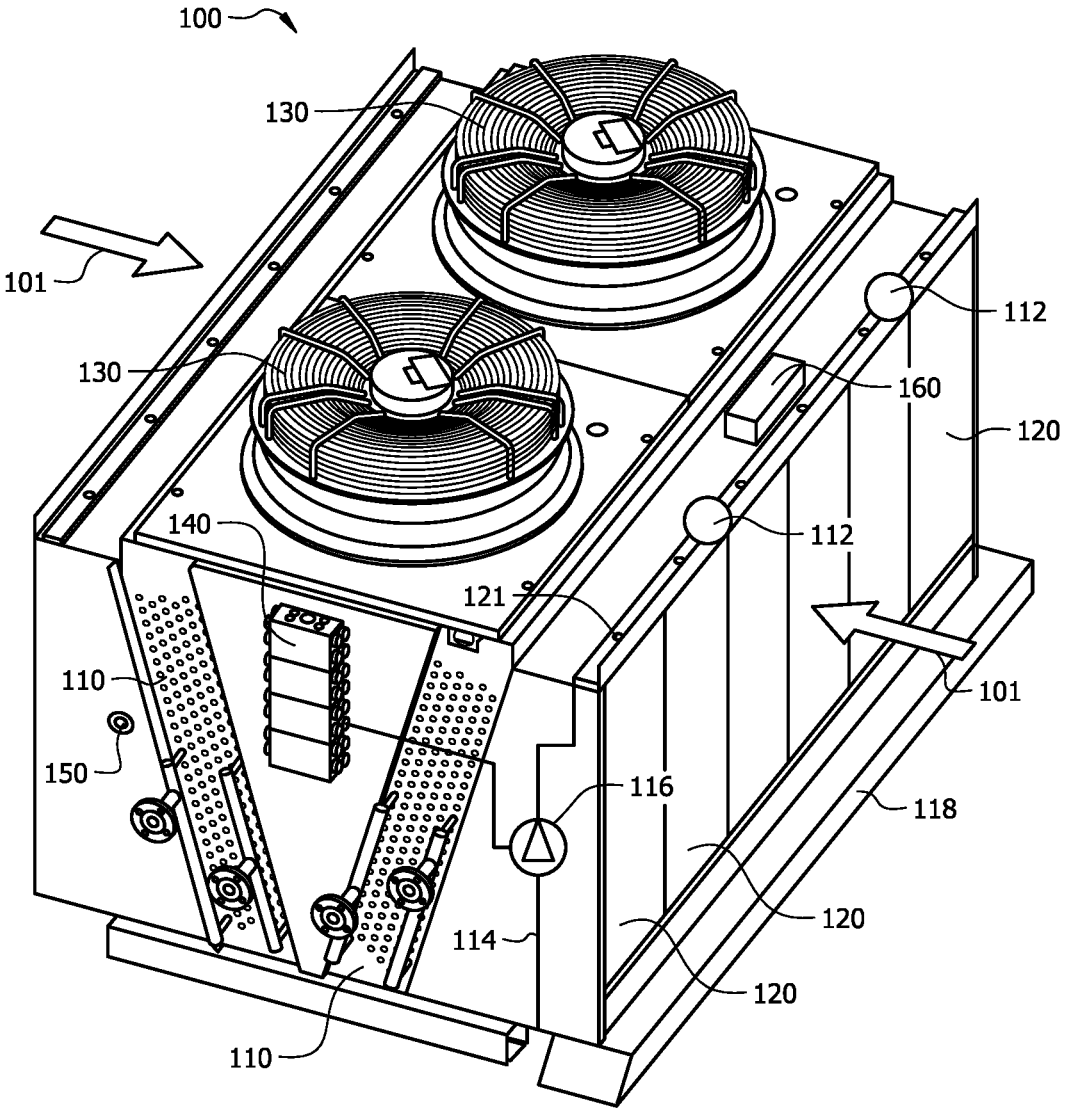
FIG. 1 illustrates an adiabatic cooling system in a closed position, according to certain embodiments.
Figure 2:
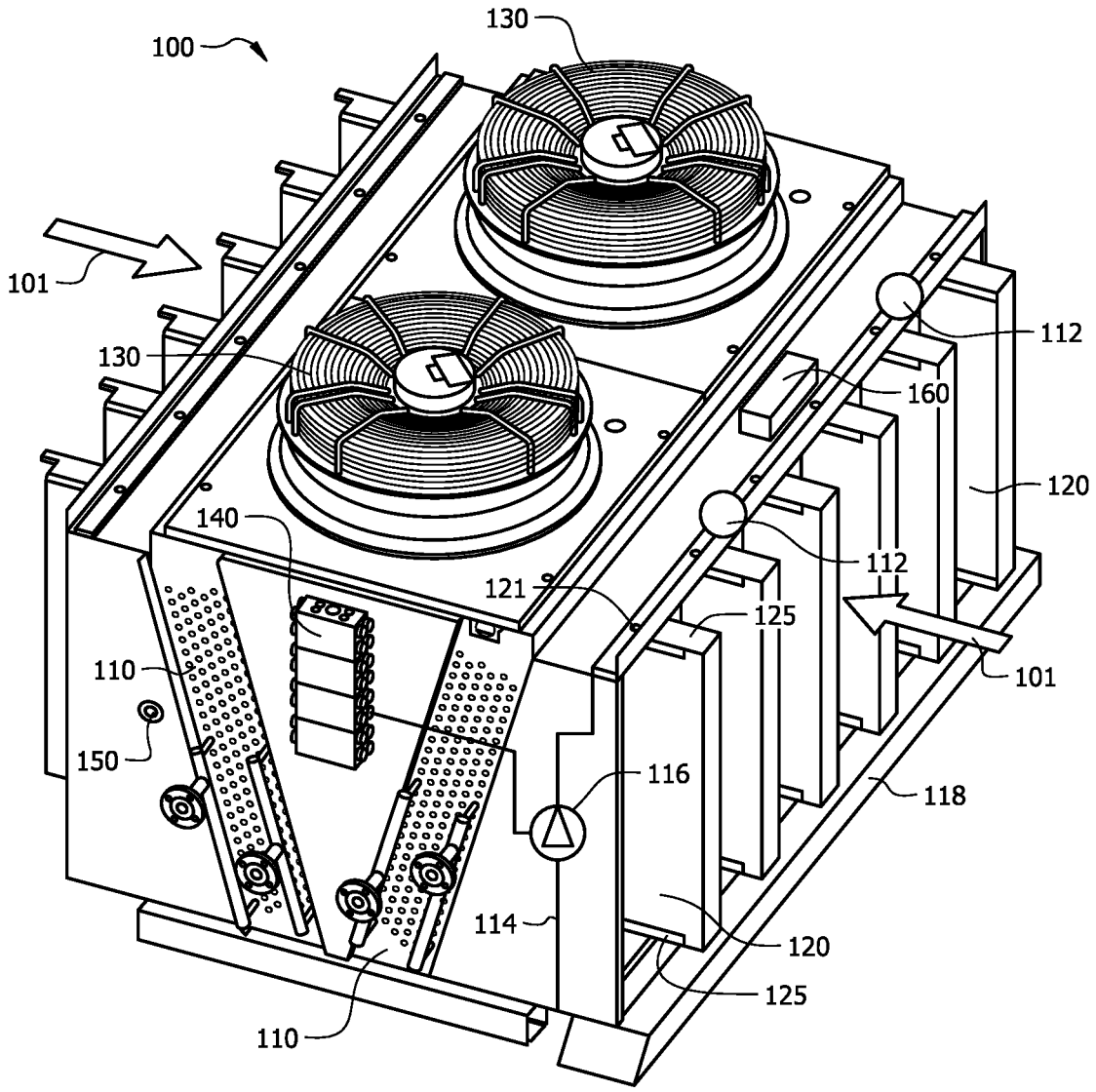
FIG. 2 illustrates an adiabatic cooling system in an open position, according to certain embodiments.

FIGS. 1 and 2 illustrate an adiabatic cooling system 100, according to certain embodiments. In some embodiments, adiabatic cooling system 100 includes one or more condenser coils 110, a plurality of adiabatic pads 120, one or more fans 130, a controller 140, and a pad pivoting system 160. In some embodiments, adiabatic cooling system 100 may include pad frames 125 (as best seen in FIG. 2) that each hold a respective adiabatic pad 120. Water, from a water distribution system (described further below) comprising a one or more nozzles 112, tubing 114, and a pump 116, is selectively applied to adiabatic pads 120 in order to cool intake air 101 as it enters adiabatic cooling system 100 but before contacting condenser coils 110. Pad pivoting system 160 may be mechanically coupled to adiabatic pads 120 or pad frames 125 in order to cause adiabatic pads 120 to move between open and closed positions as described herein. Controller 140 is communicatively coupled to pad pivoting system 160 and instructs pad pivoting system 160 to move adiabatic pads 120 between the open and closed positions.

In general, adiabatic cooling system 100 utilizes multiple adiabatic cooling pads 120 that may be rotated, pivoted, or otherwise moved between open and closed positions. In typical adiabatic cooling systems, adiabatic pads are stationary and are always in the air-intake path of intake air 101 regardless of the mode of operation of the cooling system. This may decrease the efficiency of such systems since intake air 101 must be pulled through adiabatic pads 120 even when pre-cooling is not needed (e.g., in dry modes of operation). Adiabatic cooling system 100, on the other hand, may utilize split adiabatic pads 120 that may be rotated, pivoted, or otherwise moved based on whether or not pre-cooling is needed. For example, adiabatic cooling system 100 may move adiabatic pads 120 to their open positions (e.g., as illustrated in FIG. 2) when pre-cooling is not needed (e.g., in dry modes of operation). In the open position, intake air 101 for adiabatic cooling system 100 enters adiabatic cooling system 100 and contacts condenser coils 110 without passing through adiabatic pads 120. This may decrease electricity requirements for adiabatic cooling system 100 and may increase efficiency since intake air 101 is not forced to flow through adiabatic pads 120. However, when pre-cooling is needed (e.g., a wet mode of operation), adiabatic cooling system 100 may move adiabatic pads 120 to their closed positions. In the closed position (e.g., as illustrated in FIG. 1), intake air 101 for adiabatic cooling system 100 passes through adiabatic pads 120 prior to contacting condenser coils 110. This selective opening and closing of adiabatic pads 120 may enable adiabatic cooling system 100 to conserve resources such as electricity since adiabatic pads 120 may be removed from the air-intake path when adiabatic pads 120 are not needed (e.g., in a dry mode of operation).

Adiabatic cooling system 100 may be a system used to cool a refrigerant by condensing it from its gaseous state to its liquid state. In most commercial refrigeration applications, adiabatic cooling system 100 is located outdoors and is fluidly coupled to indoor portions of the system (e.g., air handlers) via one or more refrigerant lines. In some embodiments, adiabatic cooling system 100 is a cooling tower. Adiabatic cooling system 100 includes one or more condenser coils 110 and one or more motors that turn one or more fans 130. Fans 130 draw intake air 101 into adiabatic cooling system 100 and through condenser coils 110, thereby cooling and condensing the refrigerant and providing cooling to adiabatic cooling system 100. In certain environmental situations (e.g., in high temperatures or a wet mode of operation), fans 130 draw intake air 101 into adiabatic cooling system 100 through adiabatic pads 120 that have been sprayed with water. When adiabatic pads 120 are not needed to pre-cool intake air 101 (e.g., in low temperatures or a dry mode of operation), fans 130 draw intake air 101 into adiabatic cooling system 100 without passing through adiabatic pads 120. By bypassing adiabatic pads 120 when pre-cooling of intake air 101 is not needed, the load on fans 130 is thereby reduced. This decreases power requirements and increases the efficiency of adiabatic cooling system 100. In alternate embodiments, the adiabatic pads 120 may be stationary and the fans 130 may draw the intake air 101 through the adiabatic pads 120 when pre-cooling is not needed.

During operation in the wet mode, the adiabatic cooling system 100 may collect any water exiting or being discharged from the adiabatic pads 120 from a gutter 118 disposed underneath the adiabatic pads 120. In embodiments, the gutter 118 may be configured to facilitate drainage of water from the adiabatic pads 120 and may additionally function as a water source for providing water to the adiabatic pads 120 (via the tubing 114 and pump 116 as discussed below). In previous embodiments, the adiabatic pads 120, or the pad frames 125, may have been disposed directly on top of and onto the gutter 118, wherein the gutter 118 had to provide structural support. The present disclosure provides the gutter 118 incorporating usage of one or more brackets (see FIGS. 4-5B) to improve performance of the gutter 118 and of the adiabatic cooling system 100.

Adiabatic pads 120 may be made of any appropriate material that is capable of receiving and retaining water from a water distribution system. As a specific example, adiabatic pads 120 may be made of a mesh material through which intake air 101 passes before it enters condenser coils 110. As intake air 101 passes through the wet mesh material of adiabatic pads 120, it cools and helps improve the efficiency of adiabatic cooling system 100. Adiabatic pads 120 may be in any appropriate size, shape, and configuration and are not limited to those illustrated in the included figures. In some embodiments, adiabatic pads 120 may be housed by pad frames 125, described in more detail below. In other embodiments, adiabatic pads 120 may be directly coupled to adiabatic cooling system 100 without using pad frames 125.

In some embodiments, adiabatic cooling system 100 includes pad frames 125 to hold adiabatic pads 120. Pad frames 125 may be formed from any appropriate material such as metal or plastic. As illustrated in FIG. 2, some pad frames 125 may include a top portion and bottom portion that allows adiabatic pads 120 to easily slide into and out of pad frames 125. This allows adiabatic pads 120 to be easily removed (e.g., for cleaning or replacement) and installed in pad frames 125. As described in more detail below, pad frames 125 may be pivotally coupled to adiabatic cooling system 100 at an end or center of pad frame 125. In some embodiments, pad frames 125 are mechanically and/or electrically coupled to pad pivoting system 160 in order to be moved between open and closed positions by pad pivoting system 160.

Controller 140 is any appropriate device or circuitry that controls functions of adiabatic cooling system 100. Controller 140 may be within or coupled to adiabatic cooling system 100, or it may be separate from adiabatic cooling system 100 in some embodiments. In some embodiments, controller 140 is a circuit board within adiabatic cooling system 100.

In some embodiments, controller 140 includes an interface, one or more memory devices, and a processor. Controller 140 may also include additional components typically included within a controller for a cooling system, such as a power supply, relays, and the like. The interface of controller 140 may be a conventional interface that is used to receive and transmit data for a controller, such as a micro-controller.

The one or more memory devices of controller 140 may store operating instructions to direct the operation of the processor of controller 140 when initiated thereby. In some embodiments, the memory of controller 140, or at least of portion thereof, is a non-volatile memory. The operating instructions may correspond to algorithms that provide the functionality of the methods and algorithms disclosed herein. In some embodiments, the processor of controller 140 may be a microprocessor. The interface, processor, and memory of controller 140 may be coupled together via conventional means to communicate information.

In some embodiments, adiabatic cooling system 100 includes a manual control 150. In general, manual control 150 is any user-operated device (e.g., switch, button, control, etc.) on adiabatic cooling system 100 that allows a user to control the positions of adiabatic pads 120. For example, a technician may operate manual control 150 in order to move adiabatic pads 120 from their closed positions to their open positions. This would allow, for example, the technician to gain access to condenser coils 110 (e.g., in order to power-wash condenser coils 110) and to easily remove adiabatic pads 120 for cleaning or replacement. Manual control 150 may also be operated in order to move adiabatic pads 120 from their open positions to their closed positions (e.g., after maintenance of adiabatic cooling system 100 and adiabatic pads 120 is complete). In some embodiments, manual control 150 may be communicatively coupled to controller 140 and/or pad pivoting system 160 in order to provide manual control of the positions of adiabatic pads 120.

Pad pivoting system 160 may be any electrical or mechanical system that is capable of moving adiabatic pads 120 or pad frames 125 between their open and closed positions. In some embodiments, pad pivoting system 160 includes a rack and pinion. In such an embodiment, a toothed rack portion of rack and pinion is coupled to each adiabatic pad 120 or pad frame 125, and the rack portion is mechanically coupled to a pinion portion of rack and pinion (e.g., via a gear). A motor turns the pinion portion of rack and pinion, which thereby moves the rack and all pad frames 125 or adiabatic pads 120 coupled to the rack. In general, pad pivoting system 160 may be communicatively coupled to controller 140, thereby enabling controller 140 to instruct pad pivoting system 160 to move adiabatic pads 120 or pad frames 125 between the open and closed positions.

In operation, adiabatic cooling system 100 may selectively move adiabatic pads 120 between their closed positions (e.g., as illustrated in FIG. 1) and their open positions (e.g., as illustrated in FIG. 2). In embodiments that include pad frames 125, adiabatic cooling system 100 moves adiabatic pads 120 between their closed positions and their open positions by moving the pad frames 125. When adiabatic pads 120 are in the closed position, intake air 101 for adiabatic cooling system 100 passes through adiabatic pads 120 prior to contacting condenser coils 110. When adiabatic pads 120 are in the open position, intake air 101 for adiabatic cooling system 100 is unimpeded by adiabatic pads 120 since intake air 101 does not pass through adiabatic pads 120 prior to contacting condenser coils 110. As a result, the efficiency of adiabatic cooling system 100 may be improved because fans 130 do not have to pull intake air 101 through adiabatic pads 120 when pre-cooling is not needed.

Various conditions or signals may be utilized by controller 140 to determine whether adiabatic pads 120 should be in their closed or open positions. In some embodiments, ambient temperatures may be used to control the positions of adiabatic pads 120. For example, if the ambient temperature surrounding adiabatic cooling system 100 as determined by a temperature sensor is greater than or equal to a certain temperature (e.g., 70 degrees Fahrenheit), controller 140 may determine that adiabatic cooling system 100 should be in a wet mode of operation and thereby instruct pad pivoting system 160 to move adiabatic pads 120 to their closed positions so that intake air 101 may be pre-cooled prior to contacting condenser coils 110. If the ambient temperature surrounding adiabatic cooling system 100 as determined by a temperature sensor is less than a certain temperature (e.g., 70 degrees Fahrenheit), controller 140 may determine that adiabatic cooling system 100 should be in a dry mode of operation and thereby instruct pad pivoting system 160 to move adiabatic pads 120 to their open positions so that intake air 101 is not pre-cooled prior to contacting condenser coils 110.

In some embodiments, an input to a water distribution system for adiabatic pads 120 may be used in parallel by pad pivoting system 160 to open or close adiabatic pads 120. For example, if the water distribution system for adiabatic pads 120 is enabled in order to start spraying water on adiabatic pads 120, pad pivoting system 160 may move adiabatic pads 120 from their open positions to their closed positions. Likewise, if the water distribution system for adiabatic pads 120 is disabled in order to cease spraying water on adiabatic pads 120, pad pivoting system 160 may move adiabatic pads 120 from their closed positions to their open positions.

Figure 3:
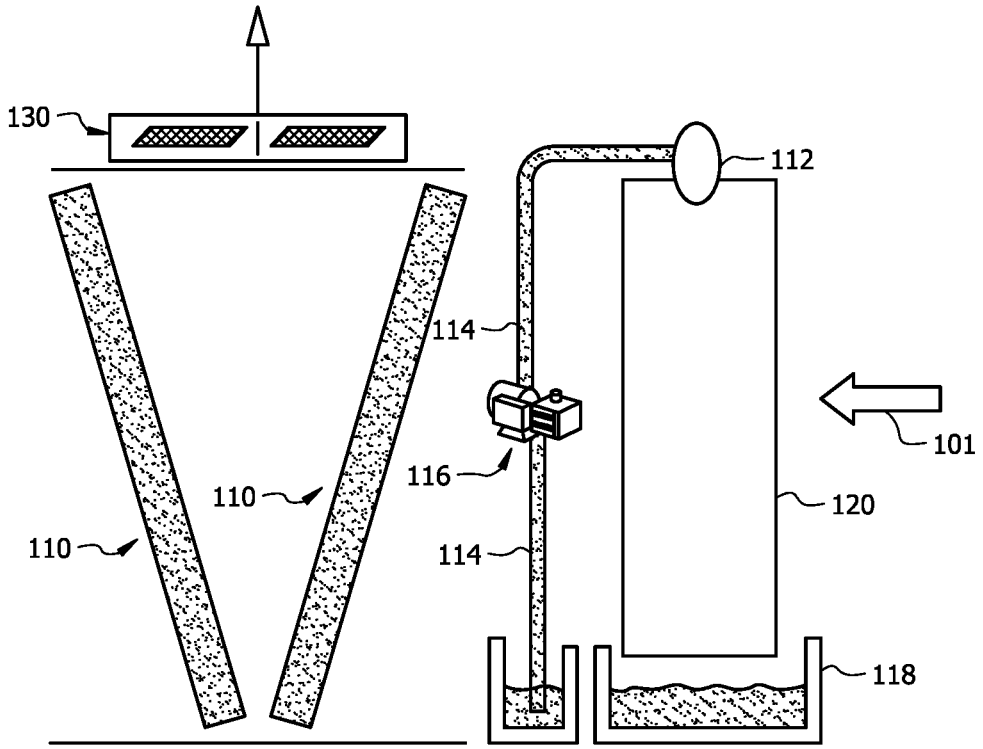
FIG. 3 illustrates a diagram showing a portion of the adiabatic cooling system of FIGS. 1-2, according to certain embodiments.

FIG. 3 illustrates a diagram showing a portion of the adiabatic cooling system 100 (referring to FIGS. 1-2). In embodiments, the nozzles 112 are operable to provide water to the adiabatic pads 120. This disclosure contemplates any number of nozzles 112 being positioned to provide water to the adiabatic pads 120. The nozzle(s) 112 may be coupled to a water source via tubing 114. The water source may be a container or tray holding water. The water source may be connected to a municipal water supply or other supply of water (e.g., to refill or maintain a necessary volume of water in the water source). In certain embodiments, the water source may be fluidly coupled to the gutter 118, wherein the water discharged from the adiabatic pads 120 and collected by the gutter 118 may be re-used.

The pump 116 may drive a flow of water from the water source out of the nozzle(s) 112 and onto the adiabatic pads 120. The pump 116 may be any appropriate pump for providing the flow of water at a sufficient pressure to produce the discharged water. For example, the pump 116 may be a high-pressure fluid pump, such as a motor-driven pump that increases the pressure of water flowing through tubing 114. Without limitations, the adiabatic cooling system 100 may employ a separate pump 116 per nozzle 112, a shared pump 116 providing flow to each nozzle 112, or a combination thereof. In some embodiments, the water source may be pressurized, and the pump 116 may be replaced with a valve that opens to allow the flow of pressurized water out of the nozzle(s) 112.

The controller 140 (referring to FIGS. 1-2) may provide for operating the pump 116. For example, the controller 140 may cause the pump 116 to activate to provide the water when the adiabatic cooling system 100 is to operate in a wet mode. As water is provided to the adiabatic pads 120, the intake air 101 produced by the fans 130 may be pre-cooled prior to engaging with the condenser coils 110.

Figure 4:
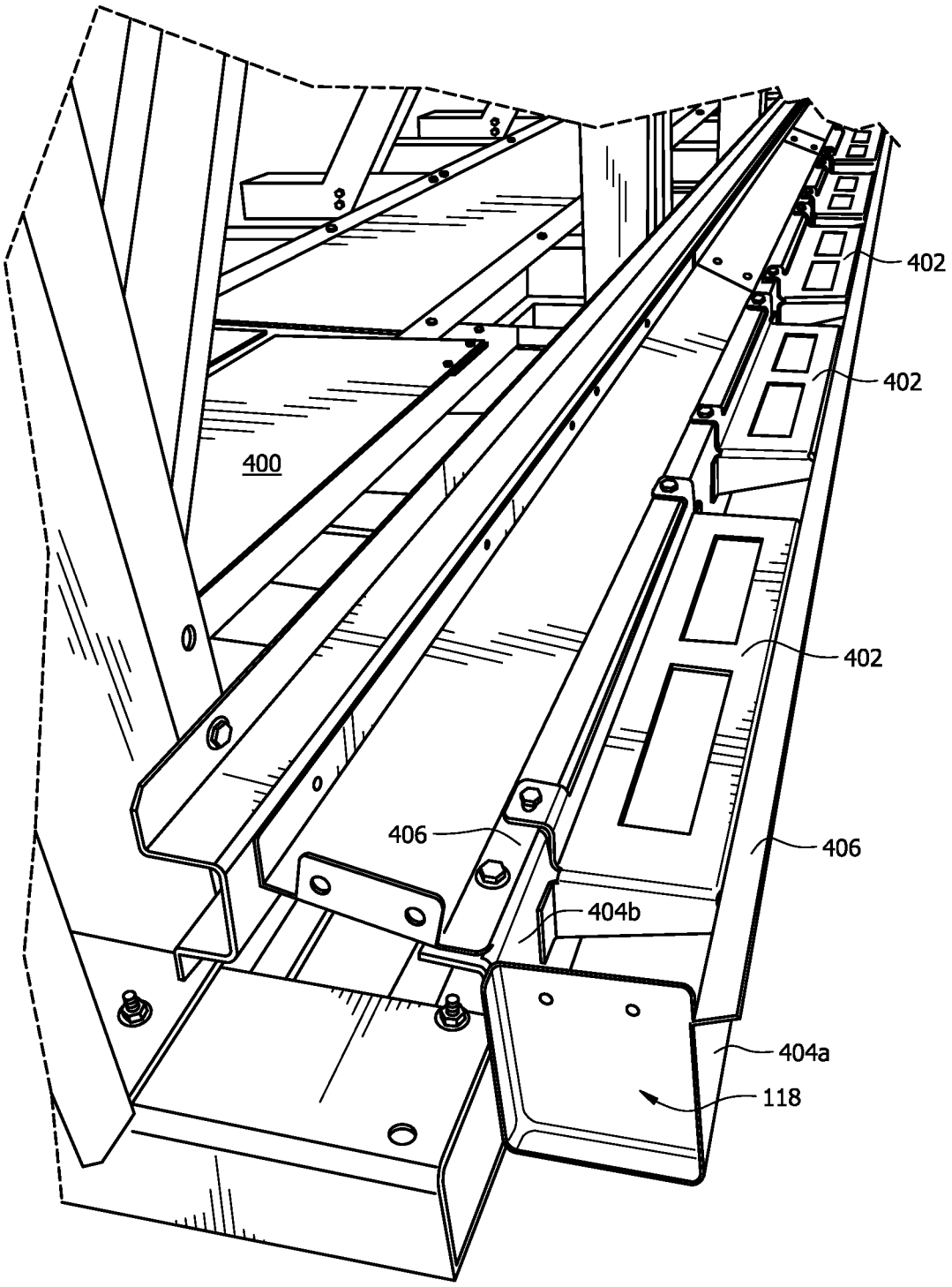
FIG. 4 illustrates a gutter of the adiabatic cooling system of FIGS. 1-2, according to certain embodiments.

FIG. 4 illustrates a portion of the adiabatic cooling system 100 (referring to FIGS. 1-2). In the illustrated embodiment, a portion of the components of the adiabatic cooling system 100 is not illustrated in order to depict certain components unable to be seen in an assembled configuration. As illustrated, the adiabatic cooling system 100 may comprise a base 400 configured to receive and house at least the one or more condenser coils 110 (referring to FIGS. 1-2) and the adiabatic pads 120 (referring to FIGS. 1-2). In embodiments, a housing may be constructed upon and integrated with the base 400 to produce an assembled adiabatic cooling system 100. As illustrated, the gutter 118 may be coupled to a side of the base 400. The gutter 118 may be disposed along a lengthwise side of the base 400 and may comprise a similar length with reference to the base 400. In other embodiments, the gutter 118 may be shorter or longer than the base 400. The gutter 118 may be any suitable size, height, shape, and any combination thereof. Further, the gutter 118 may comprise any suitable materials, such as metals, nonmetals, polymers, composites, and any combinations thereof. The gutter 118 may be configured to receive water exiting or being discharged from the adiabatic pads 120 during operation of the adiabatic cooling system 100. The gutter 118 may comprise a sloped bottom surface in order to direct the received water towards a drain or port located proximate to one end of the gutter 118.

In embodiments, the adiabatic cooling system 100 may comprise at least one bracket 402. While the present depiction in FIG. 4 illustrates a plurality of brackets 402, the present disclosure may provide for usage of a singular bracket 402 with the adiabatic system. Each bracket 402 may be any suitable size, height, shape, and any combination thereof. Further, each bracket 402 may comprise any suitable materials, such as metals, nonmetals, polymers, composites, and any combinations thereof. Without limitations, each bracket 402 may be comprised of galvanized steel, stainless steel, aluminum, and the like. Further, each bracket 402 may comprise a corrosion-resistant coating or have corrosion resistant properties. The bracket(s) 402 may be securably coupled to the gutter 118 and may be substantially disposed within the gutter 118. For example, the gutter 118 may comprise a set of walls 404 (wherein a first wall and second wall of the set of walls 404 will be referred to as "first wall 404*a*" and "second wall 404*b*," respectively) having a flange 406 extending perpendicularly therefrom. As illustrated, each bracket 402 may be secured to the flange 406 of the second wall 404*b* through the use of suitable fasteners. As described further below, the bracket 402 may employs tabs for coupling to the flange 406, wherein the tabs may be disposed out of gutter 118 and on top of the flange 406, but the remaining portion of the bracket 402 may be disposed within an internal volume defined by the gutter 118.

Figure 5A:
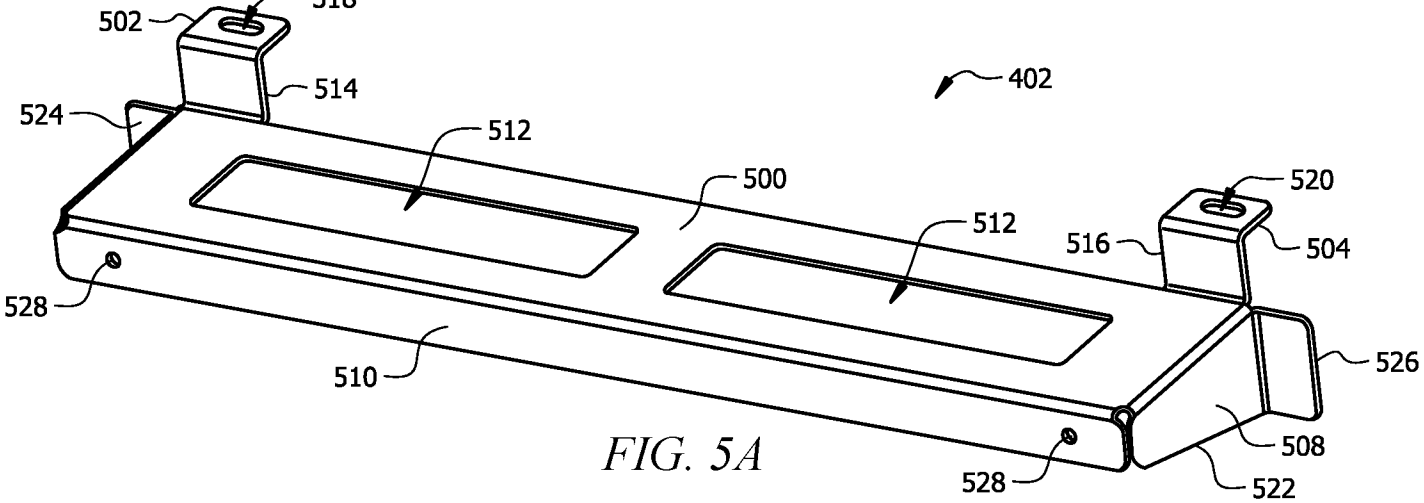
FIGS. 5A and 5B illustrate front, isometric views of a bracket, according to certain embodiments.
Figure 5B:
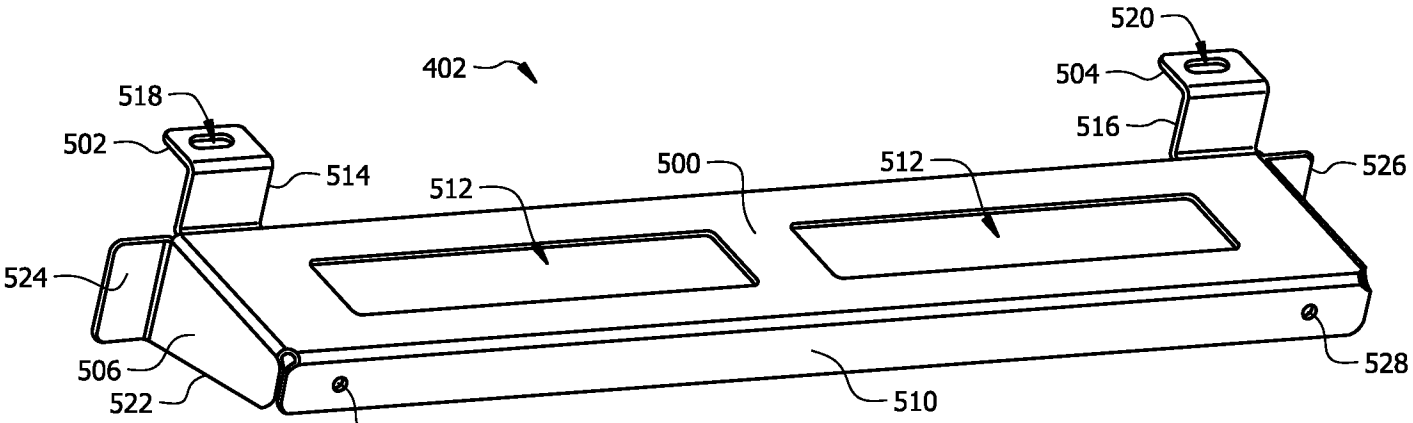

FIGS. 5A and 5B illustrate front, isometric views of the bracket 402. The bracket 402 may be configured to structurally support one or more adiabatic pads 120 (referring to FIGS. 1-2), thereby alleviating the gutter 118 (referring to FIGS. 1-2) from supporting the weight of the adiabatic pads 120. For example, at least one adiabatic pad 120 may be disposed on top of the bracket 402 in an assembled configuration of adiabatic cooling system 100 (referring to FIGS. 1-2). In embodiments, the bracket 402 may be configured to support the weight of at least one adiabatic pad 120 when wetted (i.e., about 60-90 lbs.). The bracket 402 may comprise a base surface 500, a first tab 502, a second tab 504, a first gusset 506, a second gusset 508, and a front surface 510. In embodiments, the base surface 500 of the bracket 402 may disposed within the gutter 118 between the set of walls 404 (referring to FIG. 4) and below the flanges 406 (referring to FIG. 4). The base surface 500 may define one or more openings 512 configured to allow water exiting from the adiabatic pads 120 to pass through bracket 402 and into the gutter 118. Each of the one or more openings 512 may be any suitable size and/or shape. As illustrated, the bracket 402 comprises two openings 512, but the present disclosure is not limited to said number of openings 512. Each opening 512 may comprise the same size and/or shape as the other openings 512. In other embodiments, each opening 512 may comprise a different size and/or shape. The configuration of the one or more openings 512 in relation to the base surface 500 may accommodate at least a minimum value of surface area of an adiabatic pad 120. In an example, the base surface 500 may be capable of receiving at least 50% of the surface area for a single adiabatic pad 120.

As illustrated, both the first tab 502 and the second tab 504 may be offset vertically from the base surface 500. The first tab 502 may be coupled to a first leg 514 extending upwards from the base surface 500. Likewise, the second tab 504 may be coupled to a second leg 516 extending upwards from the base surface 500, the second leg 516 being disposed at an opposite end of a length of the base surface 500 from the first leg 514. Both the first leg 514 and the second leg 516 may comprise substantially the same dimensions and at least an equivalent height. The first tab 502 and the second tab 504 may be disposed in parallel. The first tab 502 may define a first hole 518 and the second tab 504 may define a second hole 520, wherein both the first hole 518 and the second hole 520 may be configured to couple the bracket 402 to the flange 406 of the gutter 118.

In embodiments, both the first gusset 506 and the second gusset 508 may extend downwards from the base surface 500 at opposing sides of the base surface 500, the second gusset 508 being in parallel to the first gusset 506. The first gusset 506 may be disposed perpendicular to both the base surface 500 and the first leg 514. Both the first gusset 506 and the second gusset 508 may be configured to facilitate transfer of a moment produced by the weight of at least one of the adiabatic pads 120 on top of the base surface 500 into or towards the gutter 118. The size and/or shape of the first gusset 506 and the second gusset 508 may be designed to aid in transferring the produced moment. For example, the first gusset 506 and second gusset 508 may comprise a triangular shape having a bottom end 522 that tapers towards the front surface 510 of the bracket 402. The increasing height of the first gusset 506 and second gusset 508 from in relation of the length along the base surface 500 from the front surface 510 to the first and second legs 514, 516 provides structural support to receive a produced moment from a force proximate to the area of the base surface 500 near front surface 510.

Each of the first gusset 506 and second gusset 508 may have a tab extending therefrom to stabilize the bracket 402 and provide surface area for transferring the moment along an internal side of the gutter 118 (i.e., second wall 404*b* of FIG. 4). As illustrated, a first gusset tab 524 may be coupled to a side of the first gusset 506, the first gusset tab 524 being parallel to the first leg 514. A second gusset tab 526 may be coupled to a side of the second gusset 508, the second gusset tab 526 being parallel to the first gusset tab 524. Each of the first gusset tab 524 and second gusset tab 526 may be disposed along the internal side of second wall 404*b* of gutter 118 and may transfer a produced moment into the gutter 118. In embodiments, the gutter 118 may be reinforced by the base 400 (referring to FIG. 4) or some other suitable structure capable of receiving such moments and/or forces.

In the illustrated embodiment, the front surface 510 may extend downwards from the base surface 500 by a certain distance. The front surface 510 may be disposed against another internal side of the gutter 118 (i.e., first wall 404*a* of FIG. 4) opposite from the first and second gusset tabs 524, 526. In alternate embodiments, the front surface 510 may face the internal side of gutter 118 but may not necessarily be disposed flush or against said internal side of gutter 118. In certain embodiments, the front surface 510 may define one or more holes 528 configured to couple the front surface 510 to the gutter 118. For example, the gutter 118 may be warped or may have experienced some plastic deformation. To attempt to mitigate certain effects of the plastic deformation, a technician may secure the first wall 404*a* of the gutter 118 to the front surface 510 via the one or more holes 528.

The present disclosure may provide an improved adiabatic cooling system 100 having one or more brackets 402 securably coupled to the gutter 118 to support the weight of at least one adiabatic pad 120. The bracket 402 may allow for the exiting water from the adiabatic pads 120 to drain therethrough into the gutter 118, and the attachment points via the first and second tabs 502, 504 may be disposed above the water line within the gutter 118, thereby avoiding leakage.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112 (f) as it exists on the date of filing hereof unless the words "means for" or "step for" are explicitly used in the particular claim.

What is claimed is:

1. An adiabatic cooling system, comprising:

a condenser coil;

one or more adiabatic pads positioned such that intake air for the adiabatic cooling system passes through the one or more adiabatic pads prior to contacting the condenser coil;

a gutter disposed underneath each of the one or more adiabatic pads, the gutter configured to receive water exiting from the one or more adiabatic pads; and a bracket disposed within and secured to the gutter, the bracket configured to support the one or more adiabatic pads, wherein at least one of the one or more adiabatic pads is disposed on top of the bracket;

wherein the bracket comprises:

a base surface defining one or more openings configured to allow the water exiting from the one or more adiabatic pads to pass through to the gutter;

a first tab coupled to a first leg extending upwards from the base surface; and a second tab coupled to a second leg extending upwards from the base surface, the second leg being disposed at an opposite end of a length of the base surface from the first leg.

2. The adiabatic cooling system of claim 1, wherein the first tab and the second tab are disposed in parallel, wherein the first tab defines a first hole and the second tab defines a second hole, wherein both the first hole and the second hole are configured to couple the bracket to the gutter.

3. The adiabatic cooling system of claim 1, wherein the bracket further comprises a front surface extending downwards from the base surface, wherein the front surface is disposed against a first internal side of the gutter, and wherein both the first leg and the second leg are disposed against a second internal side of the gutter.

4. The adiabatic cooling system of claim 3, wherein the front surface defines one or more holes configured to couple the front surface to the gutter.

5. The adiabatic cooling system of claim 1, further comprising:

a first gusset extending downwards from the base surface, the first gusset being perpendicular to both the base surface and the first leg.

6. The adiabatic cooling system of claim 5, further comprising:

a first gusset tab coupled to a first side of the first gusset, the first gusset tab being parallel to the first leg, wherein the first gusset tab is configured to transfer a moment produced by a weight of the at least one of the one or more adiabatic pads disposed on top of the bracket to the gutter.

7. The adiabatic cooling system of claim 6, further comprising:

a second gusset extending downwards from the base surface, the second gusset being parallel to the first gusset.

8. The adiabatic cooling system of claim 7, further comprising:

a second gusset tab coupled to a first side of the second gusset, the second gusset tab being parallel to the second leg, wherein the second gusset tab is configured to transfer the moment produced by the weight of the at least one of the one or more adiabatic pads disposed on top of the bracket to the gutter.

9. The adiabatic cooling system of claim 1, further comprising:

a pump coupled to a water source; and at least one nozzle fluidly coupled to the pump and configured to direct a flow of water provided by the water source onto the one or more adiabatic pads.

10. The adiabatic cooling system of claim 1, further comprising one or more frames, wherein each frame is configured to hold a respective one of the one or more adiabatic pads.

11. An adiabatic cooling system, comprising:

a condenser coil;

one or more adiabatic pads positioned such that intake air for the adiabatic cooling system passes through the one or more adiabatic pads prior to contacting the condenser coil;

a gutter disposed underneath each of the one or more adiabatic pads, the gutter configured to receive water exiting from the one or more adiabatic pads; and a bracket disposed within and secured to the gutter, the bracket configured to support the one or more adiabatic pads, wherein the bracket comprises:

a base surface defining one or more openings configured to allow the water exiting from the one or more adiabatic pads to pass through to the gutter;

a first tab coupled to a first leg extending upwards from the base surface;

a first gusset extending downwards from the base surface, the first gusset being perpendicular to both the base surface and the first leg; and a first gusset tab coupled to a first side of the first gusset, the first gusset tab being parallel to the first leg;

wherein at least one of the one or more adiabatic pads is disposed on top of the bracket, wherein the first gusset tab is configured to transfer a moment produced by a weight of the at least one of the one or more adiabatic pads to the gutter.

12. The adiabatic cooling system of claim 11, wherein the bracket further comprises a front surface extending downwards from the base surface, wherein the front surface is disposed against a first internal side of the gutter, and wherein the first leg is disposed against a second internal side of the gutter.

13. The adiabatic cooling system of claim 12, wherein the front surface defines one or more holes configured to couple the front surface to the gutter.

14. The adiabatic cooling system of claim 11, wherein the bracket further comprises:

a second gusset extending downwards from the base surface, the second gusset being parallel to the first gusset.

15. The adiabatic cooling system of claim 14, wherein the bracket further comprises:

a second gusset tab coupled to a first side of the second gusset, the second gusset tab being parallel to the first gusset tab, wherein the second gusset tab is configured to transfer the moment produced by the weight of the at least one of the one or more adiabatic pads disposed on top of the bracket to the gutter.

16. The adiabatic cooling system of claim 11, wherein the bracket further comprises a second tab coupled to a second leg extending upwards from the base surface, the second leg being disposed at an opposite end of a length of the base surface from the first leg.

17. The adiabatic cooling system of claim 16, wherein the first tab and the second tab are disposed in parallel, wherein the first tab defines a first hole and the second tab defines a second hole, wherein both the first hole and the second hole are configured to couple the bracket to the gutter.

18. The adiabatic cooling system of claim 11, further comprising:

a pump coupled to a water source; and at least one nozzle fluidly coupled to the pump and configured to direct a flow of water provided by the water source onto the one or more adiabatic pads.

19. The adiabatic cooling system of claim 11, further comprising one or more frames, wherein each frame is configured to hold a respective one of the one or more adiabatic pads.

* * * * *